United States Patent [19]

Keller et al.

[11] Patent Number: 4,507,826

[45] Date of Patent: Apr. 2, 1985

[54] METHOD AND APPARATUS FOR OPENING FIBER BALES

[76] Inventors: Alex J. Keller, 75 Ridgeport Rd., Clover, S.C. 29710; Akiva Pinto, 525 Eastwood Dr., Gastonia, N.C. 28052

[21] Appl. No.: 434,010

[22] Filed: Oct. 13, 1982

[51] Int. Cl.[3] ..... D01G 7/04

[52] U.S. Cl. ..... 19/80 R; 19/81

[58] Field of Search ..... 19/80 R, 81

[56] References Cited

U.S. PATENT DOCUMENTS

| | | | |
|---|---|---|---|
| 3,443,285 | 5/1969 | Goldammer et al. | 19/81 |
| 3,797,072 | 3/1974 | Goldammer | 19/81 |
| 3,951,282 | 4/1976 | Keller | 19/80 R |
| 4,087,882 | 5/1978 | Keller | 19/81 X |
| 4,107,820 | 8/1978 | Mahrt et al. | 19/81 |
| 4,363,585 | 12/1982 | Keller et al. | 19/80 R |

FOREIGN PATENT DOCUMENTS

| | | | |
|---|---|---|---|
| 2800714 | 7/1979 | Fed. Rep. of Germany | 19/80 R |
| 1503477 | 10/1967 | France | 19/80 R |
| 243449 | 5/1970 | U.S.S.R. | 19/80 R |

*Primary Examiner*—Louis K. Rimrodt

*Attorney, Agent, or Firm*—Richards, Shefte & Pinckney

[57] ABSTRACT

Apparatus for removing fiber from a plurality of bales including a carriage for movement along the bales and a head which is carried by the carriage for vertical movement to engage the bales and remove fiber therefrom during traverse movement of the carriage. The head includes a rotatable beater arranged with its axis of rotation at an acute angle to the direction of movement of the carriage along the bales. A control system is provided whereby the level of the bale is sensed by photocells mounted on the head, and the head can be moved upwardly and/or downwardly if the sensed bale level is above or below predetermined levels. The control system may also move the head upwardly if the head itself is moved upwardly relative to its vertical drive assembly. A suction conveyor system is provided for conveying away removed fiber, and this system includes a perforated plate for separating out any trash, dust and the like from the fiber. Additionally, the head and/or the rotatable beater roll may be designed to provide an even suction force across the width thereof to assist in removing fiber from the beater roll and conveying such fiber away.

24 Claims, 13 Drawing Figures

Fig. 1
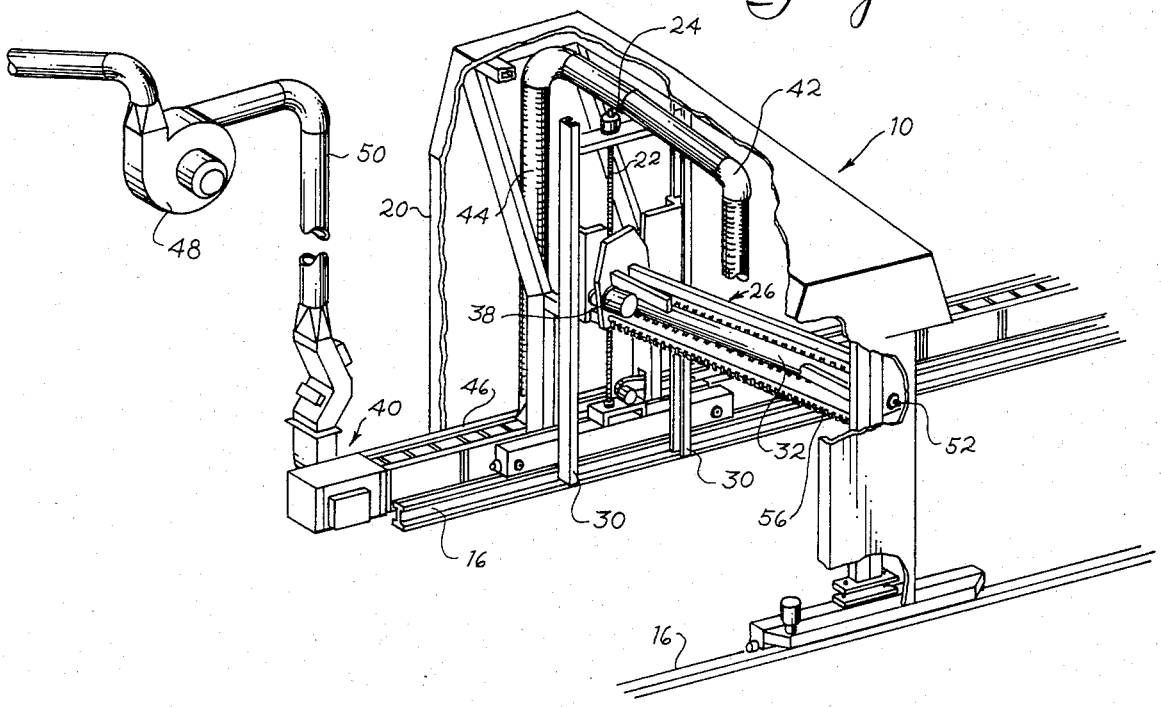
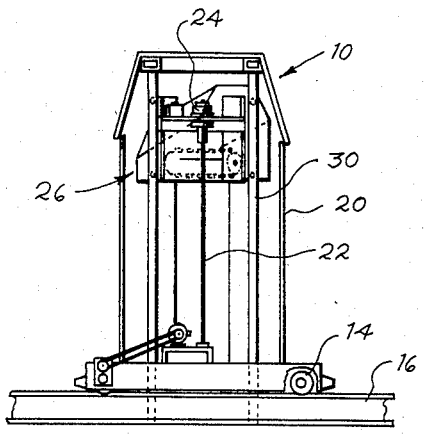
Fig. 3
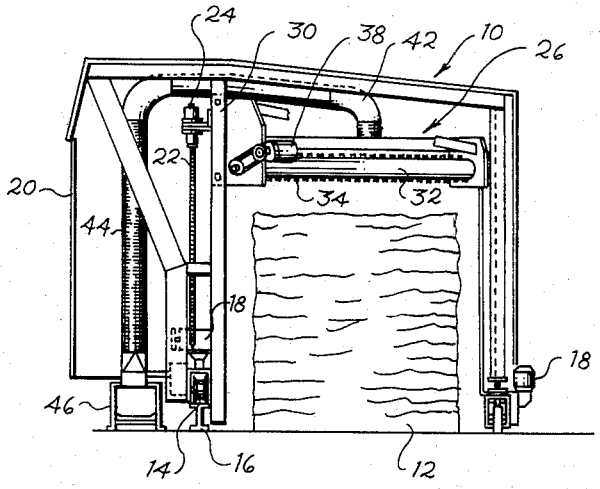
Fig. 2

METHOD AND APPARATUS FOR OPENING FIBER BALES

BACKGROUND OF THE INVENTION

This invention relates to a method and apparatus for opening fiber bales using a carriage member movable along an aligned row of bales in a plurality of passes, and a head mounted to the carriage member for movement therewith, the head also being movable in a vertical direction to engage the top surfaces of the bales and to remove fiber therefrom as the carriage member moves along the bales.

Known apparatus of the foregoing type usually includes a rotating member mounted in head and having a plurality of teeth projecting radially therefrom in circumferential rows spaced along the axis of the rotating member, and a grate is provided to extend between the rows of teeth for compressing abutment with the top surface of the bales. Heretofore, the rotating member has always been mounted in the head for rotation about an axis that is perpendicular to the direction of movement of the head across the top surface of the bales, so that the projecting rows of teeth leave spaced furrows or grooves in the bale surface, with ridges of raised fiber therebetween where the bale surface is engaged and compressed by the grate. The formation of such grooves and ridges during one pass of the head over the bales can result, during subsequent passes of the head over the same bales, in the teeth removing less fiber because they pass through the grooves and/or the teeth removing large chunks or tufts of fiber from the raised ridges, all of which tends to cause significant variations in the size of the removed fiber tufts that can have adverse and undesirable consequences during the subsequent processing of such fiber. Some efforts have been made to avoid such adverse consequences, such as by periodically changing the position of the grate bars with respect to the bale as disclosed in Marx U.S. Pat. No. 4,281,437.

Also, in conventional bale opening equipment of the aforesaid type, the perpendicular relationship between the axis of the rotating member and the direction of movement along the aligned bales results in the head removing fiber from only one bale at a time. Frequently, the aligned bales consist of fibers of different types which must be subsequently blended, but no pre-blending of the removed fibers can be obtained from conventional bale opening equipment of the aforesaid type since fiber is removed from one bale at a time, in sequence, for delivery to further processing and blending equipment.

In most known bale opening equipment of the aforesaid type, the movement of the carriage and the head are controlled to move in a set pattern by which the carriage is moved back and forth along the aligned bales, and the head is moved vertically downwardly by a predetermined amount each time the head makes a new pass along the bales. However, because the different bales in the alignment or lay down may be different in terms of density, fiber type and other variables, the movement of the head across these different bales at a constant vertical height will often result in different quantities of fibers being removed from the individual bales, whereby such fibers will not be blended in correct proportions. In Trutzschler U.S. Pat. No. 4,297,766, a particular control system is disclosed in which the total quantity of each bale is determined, and a computer is used to compare such total quantity with the number of passes to be made by the head to determine the portion of the total which is to be removed during each pass of the head. The computer then controls the movement of the head to insure that it removes such determined portion. In both of the aforesaid known control systems, the head is moved across the bales at a constant vertical height during each pass, without compensation for any variations in the level of the top surface of a bale, and since the aforesaid variations in different bales will often result in the fibers in the bale reacting differently to the passage of teeth therethrough so as to create variations in the levels of the bales themselves, the failure to compensate for these variations can result in different, uncontrolled quantities of fiber being removed from the bales by the head, even to the extent, in some cases, of the head removing quantities of fibers that are sufficient to choke the head.

In the apparatus of the present invention, the aforesaid problems of known apparatus are significantly alleviated, and additional features are also provided to improve the operation of the apparatus of the present invention.

SUMMARY OF THE INVENTION

In accordance with the present invention, the rotating fiber engaging and removing member is mounted in the head with the axis of the rotating member and the grate associated therewith disposed at an acute angle with respect to the direction of movement of the head along the top surfaces of a plurality of aligned bales, whereby the teeth projecting from the rotating member and the compressing grate on the head will not form grooves and ridges in the top surfaces of the bales. Moreover, the angled disposition of the rotating member permits it to simultaneously remove fiber from two adjacent bales to provide pre-blending of such fibers. In one embodiment, the head is formed with a suction chamber to convey the fiber removed by the rotating member, and this suction chamber is formed with a gradually decreasing volume in a direction extending from one end thereof to the other with an exhaust outlet being located at the end having the largest volume, whereby the suction is applied evenly across the extending length of the rotating member to separate fiber therefrom. In another embodiment, the suction chamber has a substantially equal volume across the length thereof with the exhaust outlet being located intermediate such length, preferably at the center, and at least a portion of the projecting teeth at one or both ends of the rotating member are angularly related to the axis thereof in a manner that will generate air currents directed toward the center of the suction chamber to assist in equalizing the air flow along the length of the rotating member. The present invention includes a further feature by which the exhaust conduit from the suction chamber includes a horizontally extending portion in which a portion of the bottom wall is perforated to permit trash, dust and the like to pass therethrough and be separated from the fiber being conveyed through the suction conduit.

The present invention includes a control system by which the movement of the head during its movement along the bales is controlled in response to variations in the level of the bale surfaces over which the head is passing, and the control system can be utilized in several different ways. First, sensing means may be provided to generate a signal when the level of the bale surface in front of the rotating member in the head is above a predetermined minimum spacing from the head, and using this signal to automatically raise the head until such predetermined minimum spacing is reestablished. Similarly, the control system may include sensing means for generating a signal when the aforesaid bale surface level is below a predetermined minimum spacing from the head, and may utilize this signal to automatically lower the head until such predetermined minimum spacing is reestablished. Such sensing means may be used to sense the bale surface level on both sides of the rotating member so that the head is automatically raised and/or lowered in both directions of movement of the head across the aligned bales.

Finally, the head means may be mounted for vertical movement on a vertically movable drive member by connecting means which normally maintains the head means in abutment with the drive member, but which permits limited movement of the head means in a vertical direction relative to the drive member if the rotating member of the head should encounter an abnormally raised portion of a bale surface. A signaling means is provided to generate a signal when the head has moved upwardly relative to the drive member, and this signal is utilized by the control system to raise the drive member until it has returned to its abutting position with the head.

BRIEF DESCRIPTION OF THE DRAWINGS

FIG. 1 is a perspective view illustrating apparatus embodying the present invention;

FIG. 2 is a front elevation view of the apparatus shown in FIG. 1;

FIG. 3 is a side elevation view of the apparatus shown in FIG. 1;

DESCRIPTION OF THE PREFERRED EMBODIMENT

Figure 4:
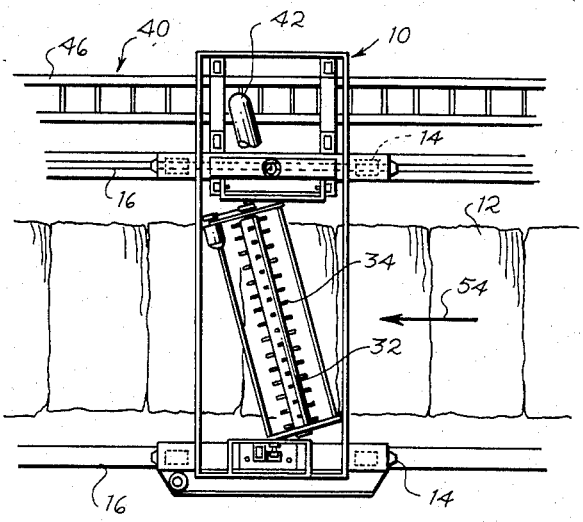
FIG. 4 is a plan view of the apparatus shown in FIG. 1.

Looking now in greater detail at the accompanying drawings, FIGS. 1–4 illustrate, generally, apparatus for opening bales to remove fiber therefrom, such fiber being conveyed to further textile processing equipment. The apparatus includes a carriage 10 that is moved back and forth over a plurality of aligned bales 12, the carriage 10 including wheels 14 which ride on fixed tracks 16 and which are driven by motors 18. The carriage 10 includes a vertical housing portion 20 on which is mounted a vertically extending screw shaft 22 operated by a motor 24 to raise and lower a head 26 that includes rollers 28 riding in vertical stanchions 30 forming part of the carriage 10. The head 26, which will be described in greater detail presently, includes a rotatable member 32 having a plurality of teeth 34 projecting radially therefrom, such teeth 34 being arranged in circumferential rows spaced along the axis of rotation of the rotatable member 32. The rotatable member 32 is mounted for rotation in the housing 36 of the head 26 on a shaft 38, and is driven by a motor 40. A suction conveyor system 40 includes a connecting portion 42 connected to, and communicating with, the interior of the head housing 36, and a vertical portion 44 extending from the conecting portion and downwardly in the carriage portion 20 to a horizontal portion 46 that extends along one of the carriage tracks 16, the end of the horizontal portion 46 being connected to a suction blower 48 by a take-off conduit 50 so that the suction generated by the blower 48 will be imposed on the interior of the head housing 36 through the suction conveyor system 40 and fiber removed by the head 26 will be withdrawn from the head 26 and conveyed to further processing equipment, such as a fiber feeding device for a card (not shown).

In general, and as will be explained in greater detail below, the operation of the above-described apparatus is as follows. The carriage 10 is driven by motors 14 along the tracks 11 to a start or "home" position at one end of the aligned bales 12. The head 26 is lowered by screw shaft 22 and motor 24 until the head 26 contacts the top surface of the first bale 12, and the carriage 10 is moved along the bales 12 with the rotatable member 32 engaging the top surface of the bales and removing fiber therefrom, which is conveyed away from the head 26 by the suction conveyor system 40. After the carriage 10 has been along the entire row of bales 12, it returns to its home position for another pass. The head 26 is preferably raised slightly at the end of a pass so that it will pass cleanly over the bales 12 during the return movement of the carriage 10, and when the carriage 10 has returned to its home position, the head 26 is vertically lowered to a position slightly below its vertical position during the preceding pass so that it will be in proper contact with the top of the bales 12 during the next pass. This procedure continues until the bales 12 are exhausted.

As best seen in FIG. 4, the rotatable member 32 is mounted in the head 26 with its shaft 52, and therefore its axis of rotation, disposed at an acute angle with respect to the movement of the head 26 and carriage 10 along the row of aligned bales, which is indicated by arrow 54. The head 26 also includes a grate 56 (see FIGS. 10 and 11) having a plurality of grate bars 58 extending across the lower portion of the head 26 and between the teeth 34 to compress the top surface of the fiber bales as discussed above. Thus, since the teeth 34 project radially from the rotatable member 32 in planes which are perpendicular to the axis thereof, and since the grate bars 58 extend across the head 26 in planes parallel to the planes of the teeth 34, it will be noted that movement of the head 26 along the top surfaces of the bales 12 in the direction of movement indicated by arrow 54 will result in the teeth 34 and the grid bars 58 being disposed in angular relation to such direction of movement, rather than parallel thereto. Accordingly, the teeth 34 and the grid bars 58 will not form grooves and ridges in the surfaces of the bales 12 as is the case with the conventional apparatus discussed above. Additionally, the angular disposition of the rotatable member 32 will result in its simultaneously removing fiber from two adjacent bales (see FIG. 4), whereby the fibers from both bales are pre-blended, to some extent, in the head housing 36 from which they are conveyed away by the suction conveyor system 40.

Figure 5:
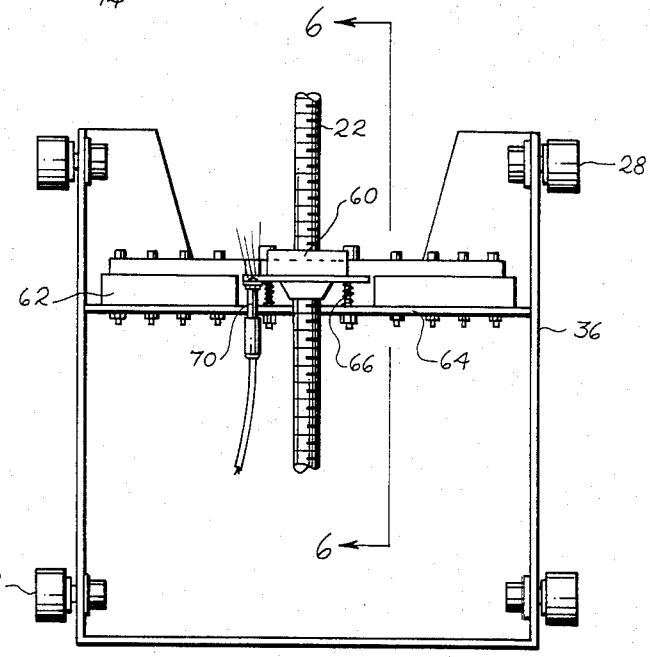
FIG. 5 is a detail view illustrating the connecting assembly between the head and the screw drive therefor.
Figure 6:
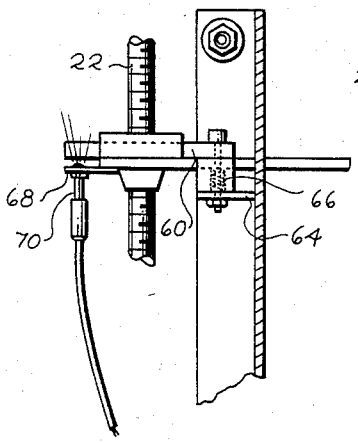
FIG. 6 is a further detail view of the connecting assembly illustrated in FIG. 5, taken at a right angle thereto.

The mounting arrangement for the head 26 is illustrated in FIGS. 5 and 6. The aforesaid screw shaft 22 extending vertically in the carriage housing portion 20 has a follower element 60 threaded thereon for vertical movement along the screw shaft 22 when it is rotated by motor 24. The head housing 36 includes a crosspiece element 62 that normally is in abutment with the top surface of the follower element 60 so that the head 26 will be carried for vertical movement by the follower element 60. Additionally, the crosspiece 62 includes a flange 64 that supports a pair of coil springs 66 disposed between the flange 64 and the bottom surface of the follower element 60. It will therefore be apparent that if the head 26 should encounter a raised portion of a bale or otherwise be caused to move upwardly, the head 26 is permitted to move upwardly relative to the follower element 60 against the bias of the springs 66 to a limited extent without damage to the head 26 or the follower element 60. The follower element 60 has an outwardly extending plate 68 in which a conventional proximity photocell 70 is disposed in spaced relation to the bottom surface of crosspiece 62. The proximity photocell 70 is designed to generate a signal whenever the spacing between the crosspiece 62 and the follower element 60 is reduced from its normal condition, thereby indicating that the head 26 has moved upwardly relative to the follower element 60 as described above, and this signal can be utilized to raise the follower element 60 until it resumes its normal abutting position with the crosspiece element 62, all as will be explained in connection with the control system of the present invention.

Figure 10:
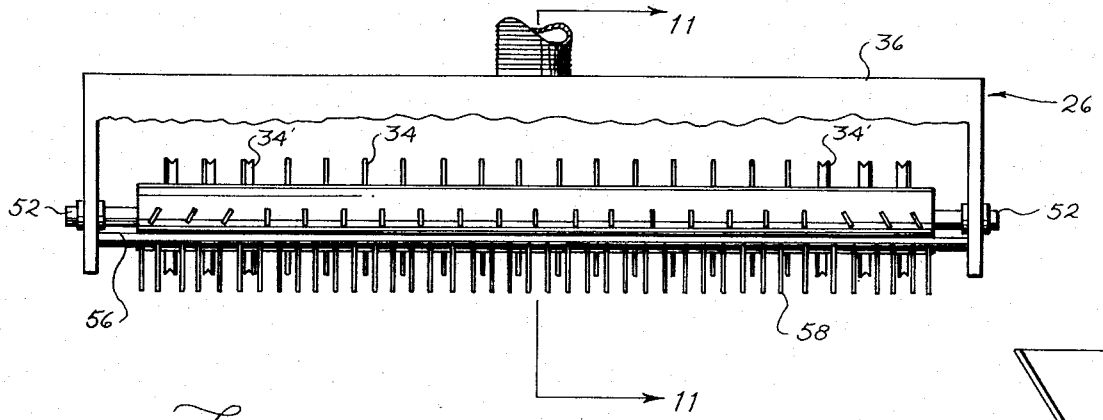
FIG. 10 is a rear view of the head according to one embodiment of the present invention.

In one embodiment of the present invention, all of the teeth 34 on the rotatable member 32 extend outwardly therefrom in planes which are perpendicular to the axis of rotation of the rotatable member 32 as shown in FIG. 4. In another embodiment of the present invention, as illustrated in FIG. 10, several rows of the teeth, indicated by reference numeral 34', at each end of the rotatable member 32 extend from the surface thereof in planes which are angularly related to such axis of rotation. The angle of the teeth 34' is selected so that they will not be in planes parallel to the direction of movement indicated by arrow 54 whereby no grooves will be formed in the bales, and so that they will act as fan blades to generate small air currents directed from the ends of the rotatable member 32 toward the center thereof where the exhaust outlet to the connecting portion 42 of the suction conveyor system 40 is located. Since the suction imposed at the center of the head housing 36 is greater at such center and somewhat diminished at the opposite ends of the head housing 36, the aforesaid air currents will assist in providing an equal air flow across the length of the rotatable member 32 to better remove and convey the removed fibers.

Figure 7:
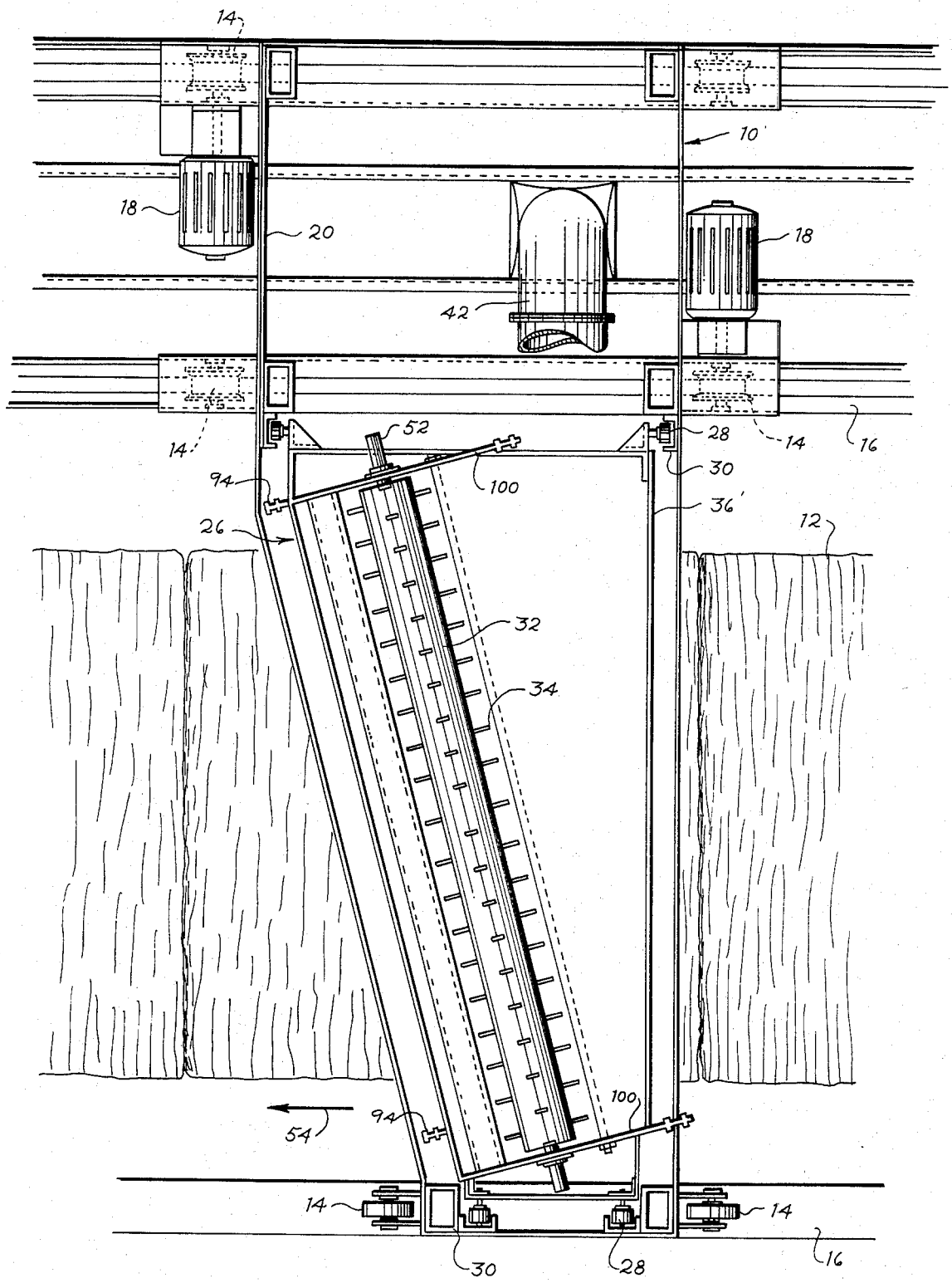
FIG. 7 is a top view illustrating an alternate embodiment of the head.

FIG. 7 illustrates yet another embodiment of head 26 in which the housing 36' thereof is formed with a gradually increasing volume across the width thereof, and the exhaust outlet for the suction conduit connecting portion 42 is located at the end of the housing 36' having the largest volume, rather than being located at the center of the head 26. This gradually increasing volume will result in the suction imposed through the exhaust outlet being more evenly distributed along the entire length of the rotatable member 32 to remove fiber therefrom.

Figure 8:
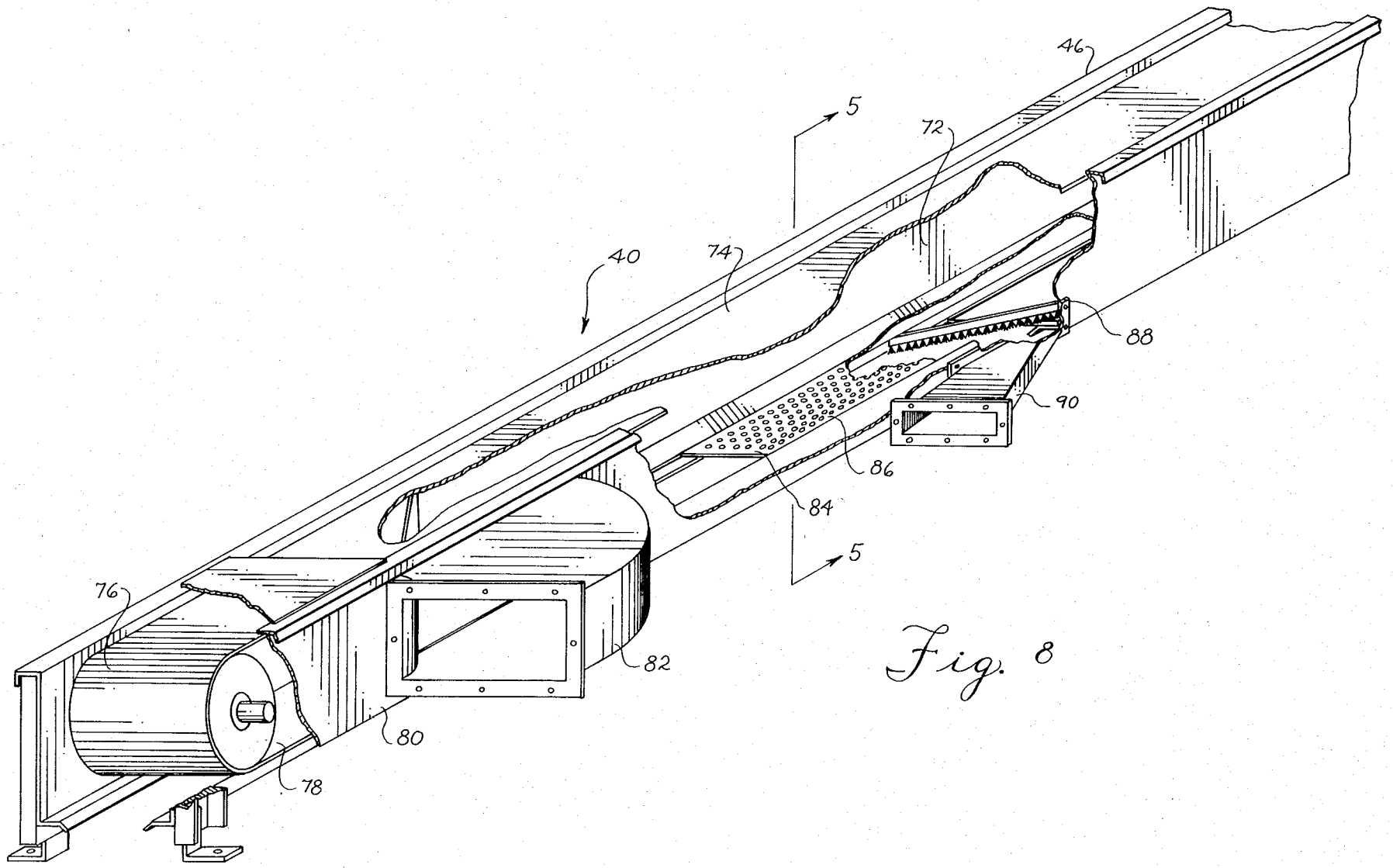
FIG. 8 is a perspective view illustrating a portion of the suction conveyor system.
Figure 9:
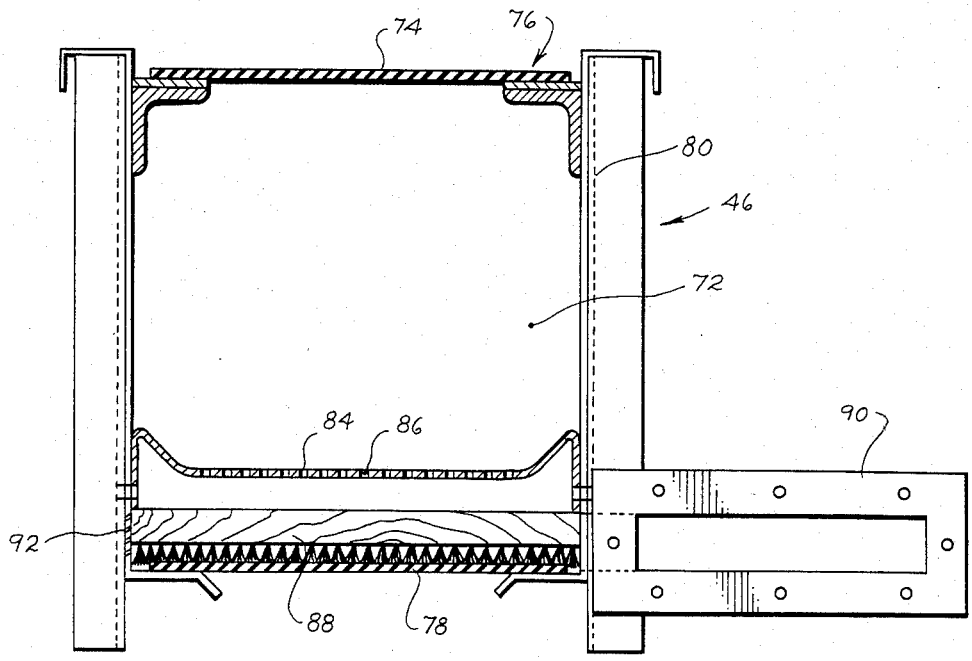
FIG. 9 is a section view taken along line 9—9 in FIG. 8.

The above-described horizontal portion 46 of the suction conveyor system 40 is illustrated in greater detail in FIGS. 8 and 9. It includes a closed rectangular housing 72 with the top wall thereof essentially consisting of the upper reach 74 of a conveyor belt 76, and with the bottom wall thereof essentially consisting of the lower reach 78 of the conveyor belt 76. The conveyor belt 76 passes around rollers 81 at each end of the horizontal portion 46 (only one end being shown in FIG. 8), and ends of the conveyor belt 76 are fixed to the sides of the vertical housing portion 20 of the carriage 10 so that fiber conveyor downwardly through the vertical conduit portion 44 will flow directly into the horizontal conduit portion 46, and so that the conveyor belt 76 will move with the carriage 10 during its movement along the bales 12. One side wall 80 of the closed housing 72 has a main exhaust outlet 82 formed therein so that the interior of the housing 72 communicates with the suction blower 48 through take-off conduit 50 as described above. A plate element 84 is mounted in the closed housing 72 to extend along the length thereof, the plate element 84 being disposed just above the lower conveyor belt reach 78 as best seen in FIG. 9. A predetermined portion of the plate 84, preferably a portion near the main exhaust outlet 82, is formed with a plurality of perforations 86 that are sized to permit trash, dust and the like to pass therethrough without permitting the fiber being conveyed thereacross to pass therethrough. A brush 88 is mounted in closed housing 72 beneath the perforated portion of plate 84, the brush 88 having bristles which extend downwardly to engage and sweep the top surface of lower conveyor belt reach 78 and being disposed in angular relation to the direction of movement of the reach 78. A secondary exhaust outlet 90 is located in the side wall 80 adjacent the brush 88 as shown in FIG. 8. During operation of the apparatus, the fiber removed from the bales 12, including any trash, dust and the like removed with the fiber, is conveyed along the plate 84 in the closed housing 72 toward the main exhaust outlet 82 (toward the left in FIG. 8), and when it passes across the perforations 86, the heavier trash and smaller dust particles will fall downwardly therethrough for collection on the upper surface of the belt reach 78 which is moving toward the brush 88 (toward the right in FIG. 8). The angled brush 88 will then sweep these particles toward the secondary exhaust outlet 90 which is connected to any convenient suction source (not shown), such suction source preferably being of a magnitude that will remove the particles without imposing any significant pulling effect on the fibers being conveyed over the perforations 86 in the plate 84. To assist in this secondary air flow, it may be desirable to form an opening in the side wall of the closed housing 72 opposite to the secondary exhaust outlet 90, and to mount adjustable louvers 92 in such opening to selectively control the air passing beneath the perforations 86 and out through the secondary exhaust outlet 90.

Figure 11:
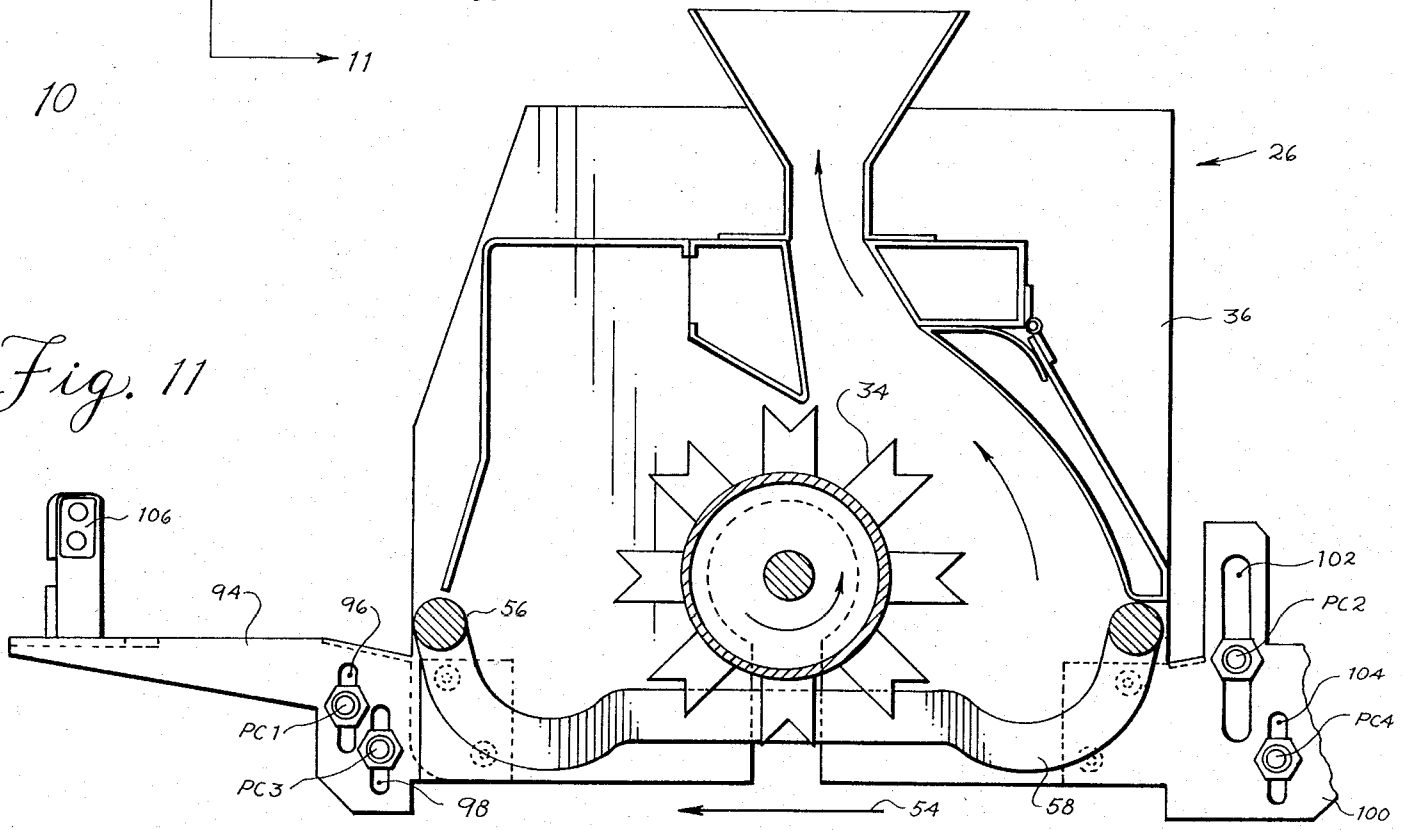
FIG. 11 is a vertical section view taken through the head illustrated in FIG. 10.

The head 26 has a pair of front brackets 94 attached at the opposite side walls of the head 26 which extend horizontally therefrom in front of the rotatable member, one such bracket being shown in greater detail in FIG. 11. Each bracket 94 is formed with an upper vertical slot 96 in which a photocell PC1 is adjustably mounted, and a lower vertical slot 98 in which a photcell PC3 is adjustably mounted. The two photocells PC1 in the respective brackets 94 are disposed in the upper slots 96 at any selected vertical position therein to face another along a line of sight extending across the front of the head 26 and somewhat above the lowest extent of the teeth 34, and the two photocells PC3 are similarly mounted at a position somewhat below the lowest extent of the teeth. Likewise, a pair of rear brackets 100 extend generally horizontally from the rear of the head 26, and each includes an upper vertical slot 102 in which a photocell PC2 is adjustably carried and a lower vertical slot 104 in which a photocell PC4 is adjustably carried. The photocells PC2 and PC4 are mounted in alignment with their opposite counterparts in the same manner as the photocells PC1 and PC3. It will therefore be apparent that when the head 26 is moving along the bales in its fiber removing direction, the oppositely mounted front pairs of photocells PC1 and PC3 will be disposed at predetermined upper and lower vertical levels and will sense the presence of any fiber or bale portion that lie in the respective lines of slight between the photocells. The upper photocells PC1 are designed to generate a signal when the level of the bale in front of the rotatable member 32 is above the predetermined vertical level of the photocells PC1 and interrupts the beam extending therebetween and the lower photocells PC3 will generate a signal when such bale level is below the predetermined vertical level of the photocells PC3 and the beam extending therebetween is not interrupted. The pair of photocells PC2 and PC4 mounted behind the head 26 operate in the same manner to generate similar signals. If desired, the brackets 94 and 100 may also carry, as a safety feature, photocells 106, one of which is clearly illustrated in FIG. 11, that is directed to emit a beam well in front of the head 26 to the defect, for example, the presence of an operator or other person who may be standing in the path of movement of the head 26, in which case an emergency signal is generated to stop the operation of the apparatus before possible injury occurs.

Figure 12:
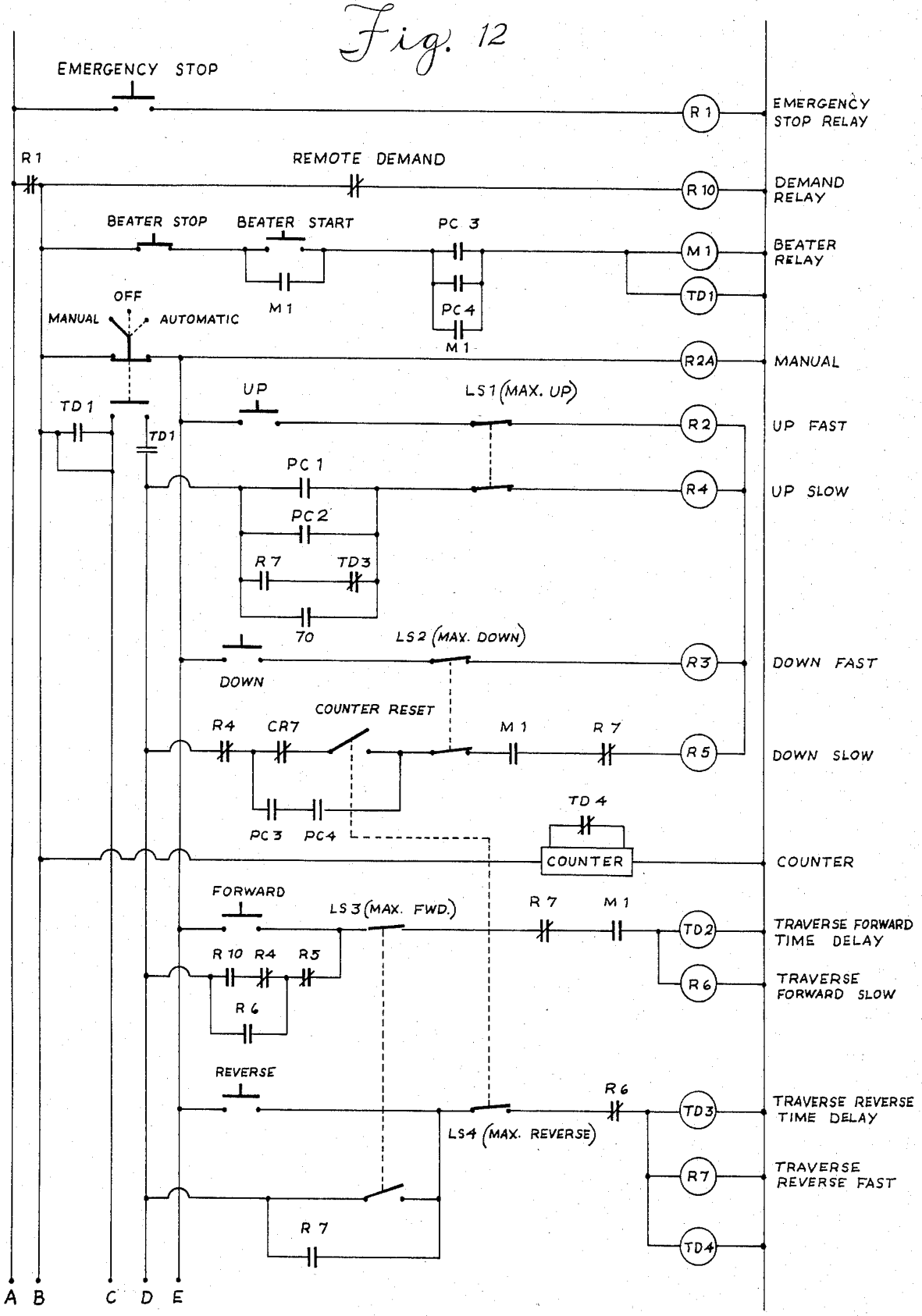
FIG. 12 is a diagrammatic wiring diagram for the control system of the present invention.

The signals generated by the aforesaid photocells are utilized to control the movement of the head 26 in a control system of the present invention, a typical example of which is illustrated diagrammatically in FIG. 12, which also includes limit switches LS1 and LS2 that are disposed in the head 26 so as to be tripped by cam surfaces (not shown) selectively positioned at upper and lower positions, respectively, on the vertical stanchions 30 of the carriage 10. The circuit also includes limit switches LS3 and LS4 disposed in the carriage 10 to be tripped by cam surfaces (not shown) selectively positioned near the opposite ends of the tracks 16. The limit switches LS1 and LS2 determine the limits of the vertical movement of the head 26, and the limit switches LS3 and LS4 determine the limits of horizontal movement of the carriage 10, as will be more apparent in the description of the control circuit below.

The control circuit includes an emergency stop relay R1 having an "emergency stop" switch in circuit therewith, such "emergency stop" switch, as shown in FIG. 12, being representative of any number of conventional switches which may be associated with the apparatus, such as the aforesaid safety photocells 106, fire detectors and the like. It will be noted that if the emergency relay R1 is energized by any such emergency switch, the contact R1 between power lines A and B will open to stop any further operation of the apparatus. The control circuit also includes a demand relay R10 which is energzed when the "remote demand" contact is closed, indicating that the processing equipment being supplied by the apparatus requires fiber, and energization of the demand relay R10 will close contact R10 in the circuit for traverse forward relay R6, whereby operation of the apparatus along the bales may start.

The control system also includes a beater relay circuit to control the operation of the motor 38 for the rotatable member, such circuit including manually operable "beater stop" and "beater start" switches, which may be located at several convenient locations about the apparatus, and the two aforesaid lower photocells PC3 and PC4.

The control circuit includes a manually operable main manual/off/automatic switch, which is shown in FIG. 12 as being in its "manual" position. In this position, it will be noted that power line E is energized which permits the head to be moved up and down at a fast speed by closing the manually operable "up" and "down" switches to close relays R2 and R3, respectively, which control the motor 24 of the screw shaft 22 to raise or lower the head 26. Similarly, the position of the carriage 10 may be manually controlled by closing the "forward" or "reverse" manual switches which operate relays R6 and R7 to control the carriage traverse motors 18. Thus, at the beginning of an operating cycle, the carriage 10 is moved to its start or home position, and the head 26 is lowered until the front lower photocell PC3 is just below the top surface of the first bale 12 in the aligned row, whereupon the contact PC3 in the beater relay circuit is closed to start operation of the rotatable member 32 which remains in operation through the holding contact M1 in the circuit. The main switch is then moved to its "automatic" position which deenergizes power line E and energizes the power line D, the two contacts TD1 between the power lines B and D having been closed by the energization of time delay relay TD1 in the beater relay circuit.

Assuming there is a demand for fiber and that relay R10 is energized as described above, the contact R10 in the traverse forward slow circuit is closed to energize relay R6 which operates motors 18 to start the carriage 10 moving forward along the bales 12. If, during such movement, the beam of the front upper photocell PC1 is interrupted (indicating that the bale level in front of the rotatable member 32 is above a predetermined level), the up slow circuit is completed through contact PC1 to energize relay R4 which raises the head 26 until the beam of photocell PC1 is no longer interrupted. Also, if the beams of both of the lower photocells PC3 and PC4 are uninterrupted by the presence of fiber (indicating that the bale level is below a predetermined level), the down slow circuit will be completed through relay R5 to move the head 26 down until the beam of either PC3 or PC4 is interrupted by fiber.

Also, it will be noted that if, during forward or reverse movement of the carriage 10, the above-described proximity photocell 70 indicates that the head 26 has been moved upwardly relative to the screw shaft 22 and its follow 60, the up slow circuit will be completed through such photocell 70 and the head 26 will be moved upwardly until the head 26 and the screw shaft 22 returns to their normal relative positions.

When the carriage reaches the end of the row of bales 12, the aforesaid limit switch LS3 is tripped to open the transverse forward slow circuit and to close the transverse reverse fast circuit, energizing time delay relays TD3, TD4 and relay R7. The energization of relays R7 and TD3 will result in the head up slow circuit being closed through contacts R7 therein and the circuit will remain closed for a predetermined time interval established by relay TD3 which, at the end of such time interval will open contact TD3 in the head up slow circuit. Thus, when the carriage 10 reaches the end of the row of the bales 12, the head 26 is automatically raised a relatively small distance to normally clear the bales during its return travel therealong by motors 18 operated in response to the closing of relay R7 and the traverse reverse fast circuit. If, during this return movement of the carriage 10, the photocells PC2, or both photocells PC3 and PC4 sense that the bale level is above or below the predetermined vertical levels at which the photocells are set, the head 26 will be moved upwardly or downwardly in the same manner as that described above in connection with movement of the carriage 10 and head 26 in its operating direction. Also, the closing of the traverse reverse fast circuit energizes time delay relay TD4 which has a time delay slightly more than relay TD3 to open contact TD4 in the counter circuit whereby the counter is not affected by the small upward movement of the head 26 as described above. When the carriage 10 reaches its homes position, limit switch LS4 opens to stop further traverse movement of the carriage 10, and the down slow circuit is completed by the closing of the counter reset switch so that the head 26 will move downwardly to an extent determined by the counter (which then opens contact CR1 a measured extent below the position of the head 26 during the preceding cycle). The automatic cycle then continues to repeat itself until the bales 12 are exhausted, whereupon the head 26 will move down to a level at which the maximum down limit switch LS2 opens to stop further operation of the apparatus.

Figure 13:
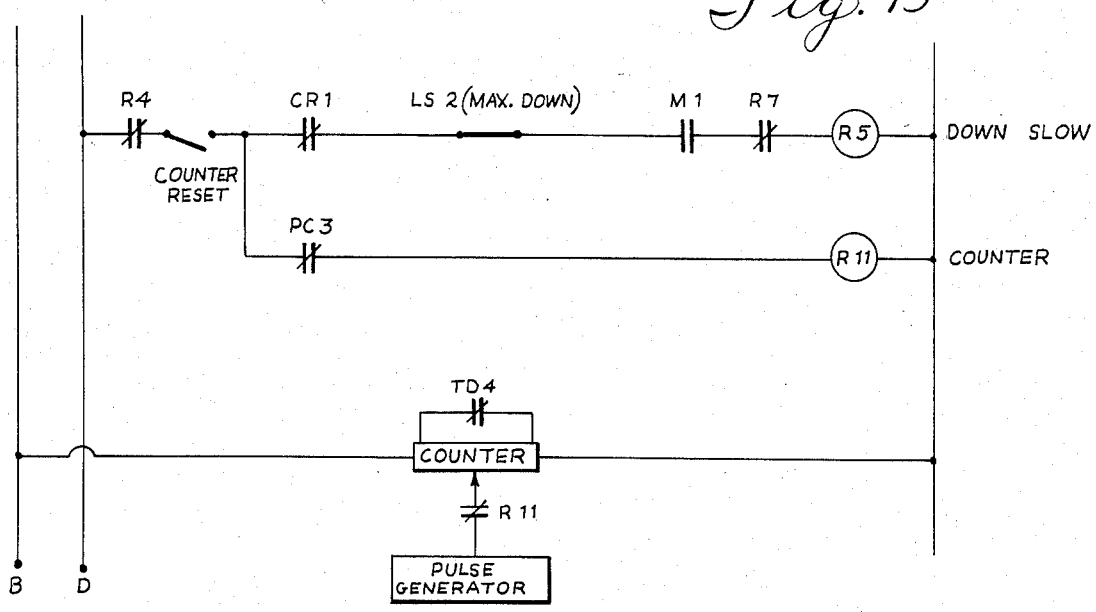
FIG. 13 is a diagrammatic partial wiring diagram illustrating an alternate embodiment of the control system of the present invention.

In FIG. 13, an alternate embodiment of the circuit system is illustrated, such alternate embodiment being the same as that in FIG. 12 except for the down slow circuit and the counter circuit. In this alternate embodiment, the lower photocells PC3 and PC4 are taken out of the down slow circuit, whereby during traverse movement of the carriage 10 the head 26 will only move up in response to the upper photocells PC1 and PC2 sensing a bale level above a predetermined level as described above. When, however, the carriage 26 reaches its home or start position, the counter reset switch closes to complete the down slow circuit through relay R5 which starts moving the head downwardly. Since the lower photocell PC3 will not be interrupted by a bale during its initial downward movement, a circuit is also completed through relay R11 which opens contact R10 and prevents the counter from receiving pulses from the pulse generator so that the counter is, in effect, inoperative. When, however, the head 26 is lowered to a position where the beam of photocell PC3 is interrupted, contact PC3 opens to deenergize relay R11 and open contact R11 to permit the counter to receive pulses. When the preset number of pulses are received, the counter will open contact CR1 to stop further downward movement of the head 26. Thus, the head 26 will move downwardly until the photocell PC3 senses the top level of the first bale, and will continue down a further small extent which is preset by the counter to assure that the head 26 is positioned to remove a desired amount of fiber from the bales.

The present invention has been described in detail above for purposes of illustration only and is not intended to be limited by this description or otherwise to exclude any variation or equivalent arrangement that would be apparent from, or reasonably suggested by the foregoing disclosure to the skill of the art.

We claim:

1. Apparatus for removing fiber from a plurality of fiber bales arranged adjacent one another in a predetermined alignment, said apparatus including carriage means movable in a direction along said aligned bales, and head means supported by said carriage for movement therewith and selectively movable in a vertical direction for making contact with the top of said bales, said head means including a rotatable member formed with fiber engaging means for engaging and removing said fiber from the top of said bales during movement of said carriage means along said bales, said rotatable member being mounted in said head means with the axis of rotation of said rotatable member at an acute angle with respect to said direction of movement of said carriage means along said aligned bales.

2. Apparatus for removing fiber as defined in claim 1 and further characterized in that said rotatable member engaging means includes a plurality of teeth projecting outwardly from said rotating member in planes that are perpendicular to said axis of rotation of said rotatable member.

3. Apparatus for removing fiber as defined in claim 2 and further characterized in that said projecting teeth are arranged in a plurality of circumferentially extending rows spaced along the axis of said rotatable member, and in that said head means includes a grate having a plurality of spaced bale-engaging bars extending between said rows of teeth at an acute angle with respect to said direction of movement of said carriage means along said aligned bales.

4. Apparatus for removing fiber as defined in claim 2 and further characterized in that said head means includes a suction chamber formed about said rotatable member and an exhaust outlet from said suction chamber located intermediate the longitudinal ends of said rotatable member, and in that said rotatable member includes a further group of teeth projecting outwardly therefrom in planes disposed in a predetermined angular relationship to said axis of said rotatable member to generate air currents directed toward said exhaust outlet during rotation of said rotatable member.

5. Apparatus for removing fiber as defined in claim 4 and further characterized in that said exhaust outlet is located adjacent the center of said rotatable member, and in that said group of angularly related projecting teeth are disposed adjacent the longitudinal end portions of said rotatable member.

6. Apparatus for removing fiber as defined in claim 2 and further characterized in that said head means includes a suction chamber formed about said rotatable member, said suction chamber having a gradually decreasing volume in a direction extending from one end of said rotatable member to the other and having an exhaust outlet located at the end of said suction chamber having the largest volume.

7. Apparatus for removing fiber as defined in claim 1 and further characterized in that said apparatus includes a suction conduit means connected to said head means to convey fiber particles engaged and removed from said bales by said engaging means, said suction conduit means having a generally horizontally extending portion having a bottom surface portion formed with perforations sized to permit trash and dust to pass therethrough without permitting the passage therethrough of said fiber particles, and in that removal means are provided to withdraw said trash and dust passing through said perforations from said suction conduit means.

8. Apparatus for removing fiber as defined in claim 7 and further characterized in that said suction conduit includes a vertical portion extending downwardly through said carriage means and a horizontal portion extending along the path of travel of said carriage means, in that said perforated bottom surface portion is disposed in said horizontal portion, and in that said removal means includes means for imposing a suction through said perforated bottom surface portion.

9. Apparatus for removing fiber as defined in claim 1 and further characterized in that said apparatus includes sensing means for sensing the level of the top bale surface immediately in front of said rotatable member during its movement across said bale surface, and includes control means responsive to said sensing means to automatically raise said head means in its vertical direction when said sensed bale level is above a first predetermined vertical level.

10. Apparatus for removing fiber as defined in claim 9 and further characterized in that said sensing means includes first signal generating means fixed to said head means for movement therewith, said first signal generating means generating a first signal as long as said bale level is above the vertical level of said first signal generating means, and in that said control means operates to continue raising said head means for only as long as said first signal is being generated.

11. Apparatus for removing fiber as defined in claim 9 and further characterized in that said control means is also responsive to said sensing means to automatically lower said head means in its vertical direction when said bale level is below a second predetermined vertical level.

12. Apparatus for removing fiber as defined in claim 11 and further characterized in that said sensing means includes second signal generating means generating a second signal as long as said bale level is below the vertical level of said second signal generating means, and in that said control means operates to continue lowering said head means for only as long as said second signal is being generated.

13. Apparatus for removing fiber as defined in claim 11 and further characterized in that said sensing means includes a first pair of photoelectric cells mounted on said head means on opposite sides, respectively, of said rotatable member, and a second pair of photoelectric cells mounted on said head on opposite sides, respectively, of said rotatable member and in vertically spaced relation beneath said first pair of photoelectric cells.

14. Apparatus for removing fiber as defined in claim 1 and further characterized in that said head means is mounted on a vertical drive member by connecting means normally maintaining said head means in an abutting position on said drive member and permitting limited movement of said head means in a vertical direction relative to said drive member, in that signaling means is provided to generate a signal when said head means is moved relative to said drive member, and control means responsive to said signal to raise said drive member until said head means and said drive member return to said abutting position.

15. Apparatus for removing fiber from a plurality of fiber bales arranged adjacent one another in a predetermined alignment, said apparatus including carriage means movable along said aligned bales, head means supported by said carriage means for movement therewith and selectively movable in a vertical direction for making contact with the top of said bales, said head means including a rotatable member formed with fiber engaging means for engaging and removing fiber from the top of said bales during movement of said carriage means along said aligned bales, sensing means for sensing the level of the bale surface immediately in front of said rotatable member during its movement across said bale surface, and control means responsive to said sensing means to automatically raise said head means in its vertical direction when said sensed bale level is above a first predetermined vertical level.

16. Apparatus for removing fiber as defined in claim 15 and further characterized in that said sensing means includes first signal generating means fixed to said head means for movement therewith, said first signal generating means generating a first signal as long as said bale level is above the vertical level of said first signal generating means, and in that said control means operates to continue raising said head means for only as long as said first signal is being generated.

17. Apparatus for removing fiber as defined in claim 15 and further characterized in that said control means is also responsive to said sensing means to automatically lower said head means in its vertical direction when said bale level is below a second predetermined vertical level.

18. Apparatus for removing fiber as defined in claim 17 and further characterized in that said sensing means includes second signal generating means generating a second signal as long as said bale level is below the vertical level of said second signal generating means, and in that said control means operates to continue lowering said head means for only as long as said second signal is being generated.

19. Apparatus for removing fiber as defined in claim 17 and further characterized in that said sensing means includes a first pair of photoelectric cells mounted on said head means on opposite sides, respectively, of said rotatable member, and a second pair of photoelectric cells mounted on said head on opposite sides, respectively, of said rotatable member and in vertically spaced relation beneath said first pair of photoelectric cells.

20. Apparatus for removing fiber from a plurality of fiber bales arranged adjacent one another in a predetermined alignment, said apparatus including carriage means selectively movable along said aligned bales, head means supported by said carriage means for movement therewith and selectively movable in a vertical direction for making contact with the top of said bales, said head means including a rotatable member formed with fiber engaging means for engaging and removing fiber from the tops of said bales during movement of said carriage means along said aligned bales, sensing means carried by said head means for determining when the level of the bale surface immediately in front of said rotatable member during its movement along said aligned bales is within a predetermined range, and control means responsive to said sensing means and operated to raise said head means when said sensed bale surface level is above said predetermined range and to lower said head means when said sensed bale surface level is below said predetermined range.

21. Apparatus for removing fiber as defined in claim 20 and further characterized in that said control means is operative to raise and lower, respectively, said head means until said sensed bale surface level is within said predetermined range.

22. A method of removing fiber from a plurality of fiber bales arranged adjacent one another in a predetermined alignment, said method comprising the steps of initially positioning fiber engaging and removing member at a vertical height having a predetermined relationship to the level of the top surface of said one bale, and the improvement comprising moving said member in a generally horizontal direction along the top surfaces of other of said bales at said vertical height while sensing the level of the bale surface in front of said member during said generally horizontal movement thereof to determine when said sensed bale level surface varies from said predetermined relationship, and automatically changing the vertical height of said member during said generally horizontal movement thereof to maintain it within said predetermined relationship to the level of said bale surface being sensed.

23. Apparatus for removing fiber from a plurality of bales arranged adjacent one another in a predetermined alignment, said apparatus including carriage means selectively movable along said aligned bales, head means supported by said carriage means for movement therewith and selectively movable in a vertical direction for making contact with said bales, said head means including a rotatable member formed with fiber engaging means for engaging and removing fiber from said bales, and a suction conveyor system communicating with said head means to withdraw and carry away fiber removed by said rotatable member, said suction conveyor system including a generally horizontally extending conduit portion through which said removed fiber is conveyed, said conduit portion having a bottom wall portion formed with perforations sized to permit trash and dust to pass therethrough without permitting said fiber to pass therethrough, and removal means associated with said conduit portion to withdraw said trash and dust passed through said perforations from said conduit portion.

24. Apparatus for removing fiber as defined in claim 23 and further characterized in that said conduit portion includes a moving conveyor surface beneath said perforations to receive said trash and dust passing therethrough, and sweeper means engaging the surface of said conveyor surface and disposed at an angle to the direction of movement thereof to thereby direct said trash and dust to one side of said conveyor surface for removal by said removal means.

* * * * *